United States Patent [19]

Young et al.

[11] 4,054,219

[45] Oct. 18, 1977

[54] DRAINABLE CONTAINER BASE

[75] Inventors: William C. Young, Southfield, Mich.; John S. Frazer, Pequannock, N.J.

[73] Assignee: Beatrice Foods, Chicago, Ill.

[21] Appl. No.: 690,016

[22] Filed: May 26, 1976

[51] Int. Cl.[2] ..... B65D 1/02

[52] U.S. Cl. ..... 215/1 C; 220/70

[58] Field of Search ..... 215/1 C; 220/66, 70, 220/72

[56] References Cited

U.S. PATENT DOCUMENTS 3,598,270 8/1971 Adomaitis ..... 215/1 C

*Primary Examiner*—Donald F. Norton

*Attorney, Agent, or Firm*—John J. Pavlak

[57] ABSTRACT

A base for a container is disclosed which prevents the collection of liquids in the base when the container is stored or washed in an upside down position. The preferred embodiment disclosed consists of a central section having a series of radially extending crests and troughs connected by surfaces inclined toward the troughs and a raised rim surrounding the central section which has a series of depreseions corresponding to the outer ends of the troughs.

8 Claims, 6 Drawing Figures

FIG. 3
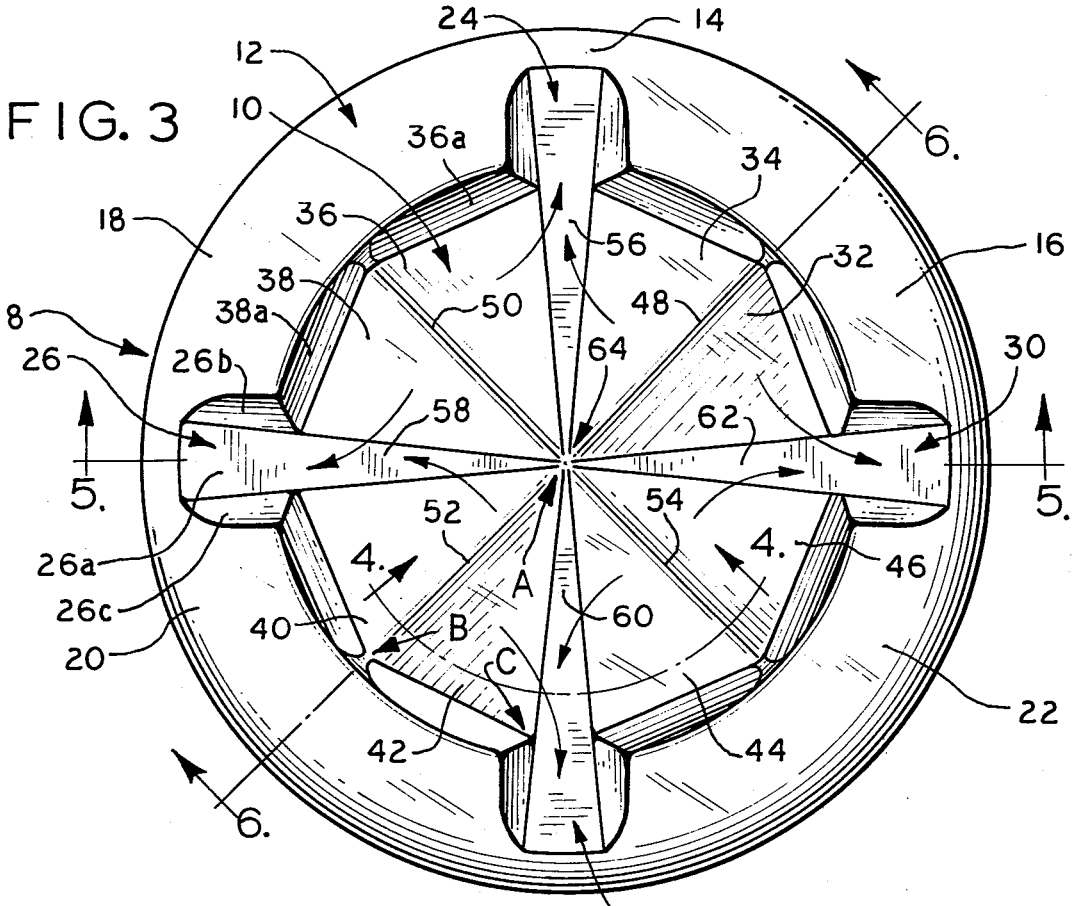
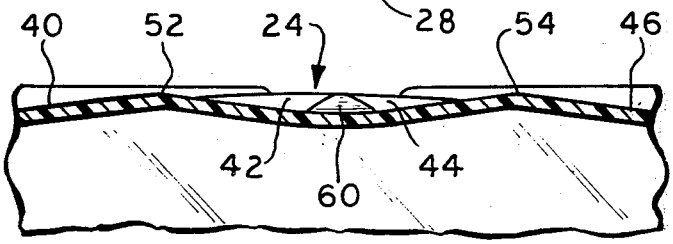
FIG. 4
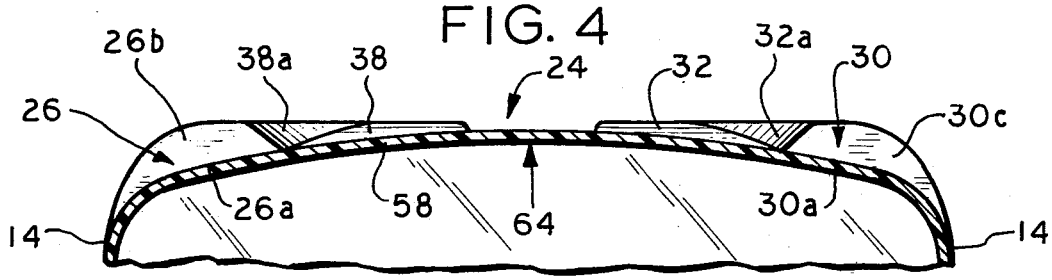
FIG. 5
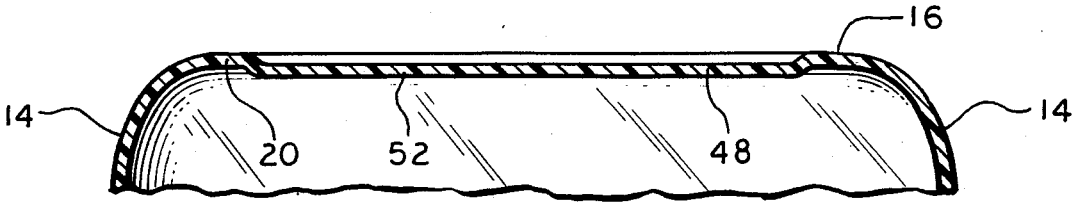
FIG. 6

DRAINABLE CONTAINER BASE

BACKGROUND OF THE INVENTION

This invention relates to a container having a base which will drain liquids poured or dropped on the base when the container is in an upside down position.

Typical, large round bottles or liquid containers, such as those used for water coolers or to store chemicals, have a base which consists of a concave center surrounded by a raised rim which provides the resting area which contact the surface on which the bottle rests when it is in its upright position. This type of base has been used for many years because its shape provides one of the most convenient ways of providing strength to the bottom of the bottle.

When these types of bottles are returned for reuse, they must be washed to remove any contaminants before they can be refilled. For large bottles, such as those used in water coolers, this typically involves a washing with a caustic solution while the bottle is held upside down in order to promote drainage of the caustic from the interior of the bottle. However, because the bottle is upside down, caustic collects in the concave center of the base. Since the caustic solution is normally collected and reused, this results in increased caustic consumption and washing costs.

SUMMARY OF THE INVENTION

The bottle or container of this invention has a base which drains, rather than retains, liquids when the bottle is in an upside down position. When viewed from this inverted or upside down position, the base has a raised outer rim which provides a generally flat bottom surface for resting the container on a floor or other surface. The raised outer rim has a series of depressions or low points which permit liquids to drain past the rim when the bottle is upside down. The base also has a central section which is surrounded by the rim. The central section of the base has a raised center or a series of high points which are above the level of the depressions in the rim but which extend no higher than the level of the rim itself. The lowest points of the central section occur along the outer edge and are located adjacent to the rim depressions to permit the liquid to readily drain from the center of the base. Essentially all of the intermediate points or surfaces of the central section are sloped or inclined to prevent the accumulation of liquid when the bottle is inverted and are arranged to direct the liquid toward the depressions in the rim. This structural arrangement permits easy drainage of the wash liquid from the base when the bottle is washed in an upside down position.

In a preferred embodiment of this invention, the central section of the base is provided with a series of generally flat, triangular shaped, inclined surfaces which form a series alternating, radially extending crests and inclined troughs. The intersection of the radially extending crests form a raised center for the base and the crests function as reinforcing ribs which provide added strength. The outermost ends of the troughs correspond to the low points of the central section of the base and are positioned for flow communication with the depressions in the rim. The inclined surfaces are connected to the inner edge of the rim by a series of shoulders which extend from the rim.

In another preferred embodiment, the inclined surfaces are connected to the inner edge of the rim by a series of shoulders which extend from the rim.

In another preferred embodiment, the inclined surfaces between the radially extending crests function as a single smooth sloped surface which is generally inclined toward and has its lowest point immediately adjacent the inner end of the rim depression.

Additional features and advantages of this invention are described in, and will appear from the description of the preferred embodiments which follow and the drawings to which reference is now made.

BRIEF DESCRIPTION OF THE DRAWINGS

FIG. 3 is a bottom elevation view of the bottle of FIG. 1 illustrating the various surfaces which comprise the drainable base of this invention.

FIG. 4 is a sectional view, slightly vertically enlarged, taken along the curved line 4—4 in FIG. 3 illustrating the variation in elevation of the various surfaces which comprise the central section of the drainable base.

FIG. 5 is a sectional view, slightly vertically enlarged, taken along line 5—5 in FIG. 3 illustrating the shape of the base between two opposite rim depressions along two troughs and the center.

FIG. 6 is a sectional view, slightly vertically enlarged, taken along line 6—6 in FIG. 3 illustrating the shape of the base along the crests.

DESCRIPTION OF THE PREFERRED EMBODIMENTS

Figure 2:
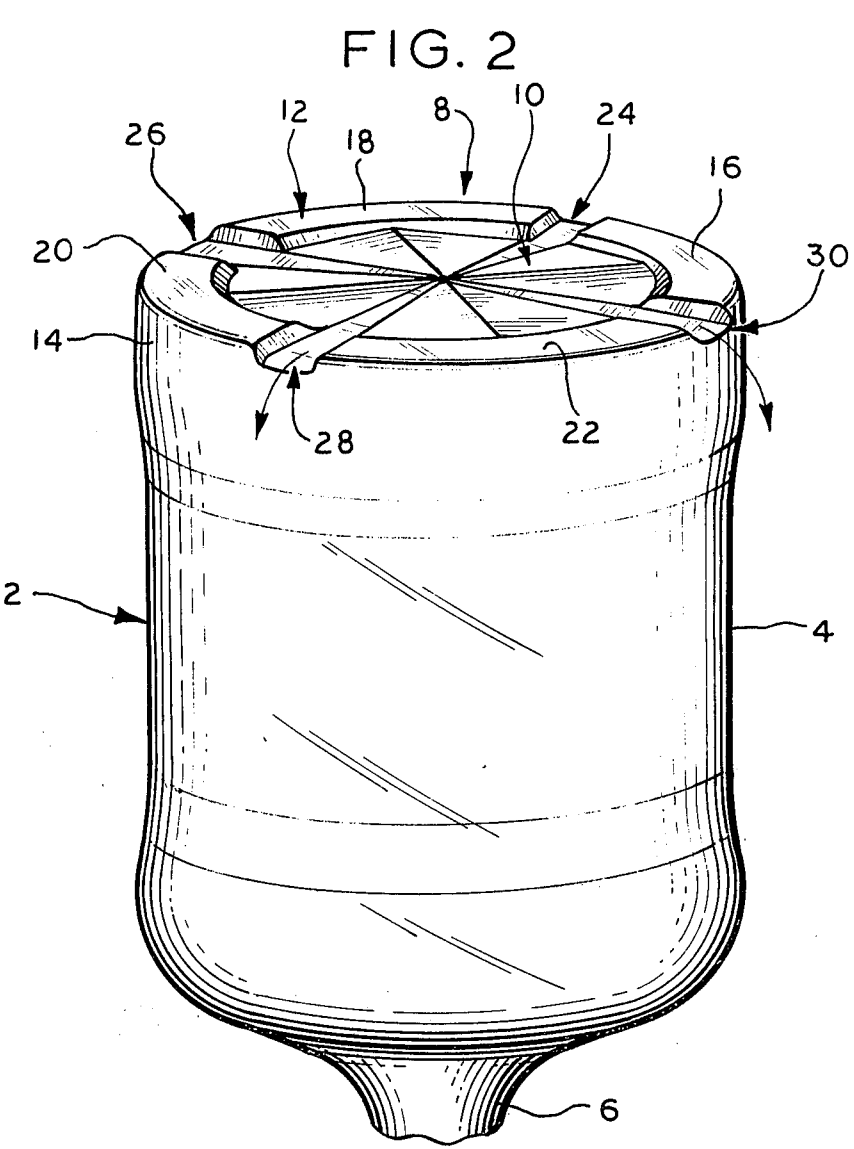
FIG. 2 is a perspective view of the bottle of FIG. 1 in an inverted position.
Figure 1:
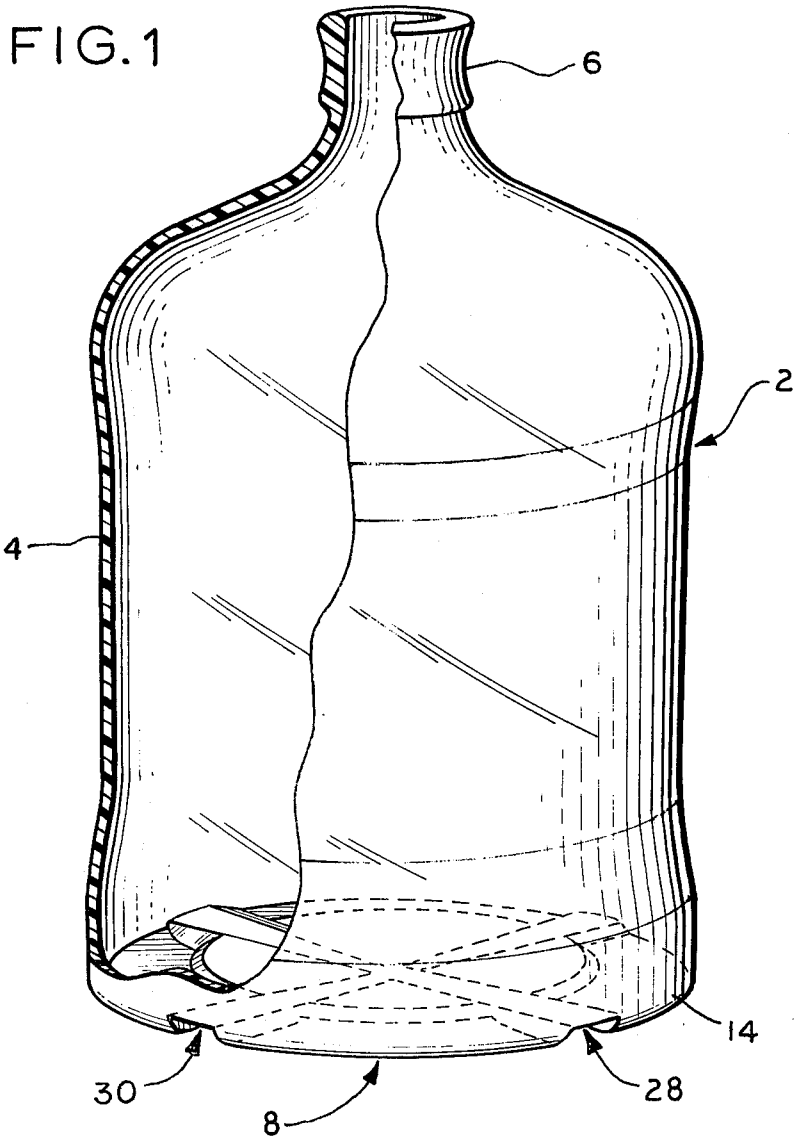
FIG. 1 is a perspective view of a large, round bottle incorporating a preferred embodiment of the drainable base of this invention. This view has a portion of the bottle broken away and phantom lines added to better illustrate the features of the drainable base.

While the drainable base of this invention may be adapted to containers and bottles having various shapes and sizes, FIGS. 1 and 2 illustrate a particularly preferred embodiment, a large, round bottle 2 which has a liquid capacity of approximately 5 gallons and is used in conventional water coolers. This bottle 2 has a long, large diameter side wall 4, a relatively narrow neck 6 and a drainable base 8. This bottle 2 is preferrably molded from strong thermoplastics such as polycarbonates and the like.

The drainable base 8 is best viewed when the bottle is in its inverted or upside down position as in FIGS. 2 and 3. The base 8 generally comprises a central section 10 surrounded by a circular rim 12 which is integral with the lower end 14 of side wall 4 of the bottle.

Rim 12 has four raised, generally flat bottomed, arcuately extending rim sections 16, 18, 20, 22 which provide the resting area which comes into contact with the floor or other surface when the bottle is in its normal upright position. Rim sections 16, 18, 20, 22 are separated from one another by a series of four depressions or gaps 24, 26, 28, 30 which are provided in rim 12 to permit the washing solution and other liquids to drain from the central section 10 of base 8 when the bottle is in its inverted position. As illustrated with depression 26, the gaps in the rim have a center surface **26*a* and two side walls 26*b*, 26*c* which in effect form a channel for the flow of liquid from central section 10. The center surface 26*a* has a slight curvature (see FIG. 5) so that the outer end of surface 26***a* which is integral with side wall 14 is lower than the inner end which is adjacent central section 10.

The central section 10 of base 8 consists of a series of alternating, radially extending ridges or crests 48, 50, 52, 54 and inclined troughs 56, 58, 60, 62 and a series of inclined surfaces 32, 34, 36, 38, 40, 42, 44, 46, the edges of which form the crests 48, 50, 52, 54 and feed liquid to the troughs 56, 58, 60, 62 for drainage when the bottle is in the inverted position.

The radially extending crests 48, 50, 52, 54 intersect at the center 64 of both central section 10 and base 8. These crests act as reinforcing ribs which provide added strength to the base and permit the abandonment of the concave central section generally used heretofore. As illustrated, crests 48, 50, 52, 54 all have essentially the same elevation along their entire length (see FIG. 6). Alternatively, one or more of crests 48, 50, 52, 54 can vary in elevation along its length so that the crests are somewhat higher at a given point than they are at others. Preferably, the high point of each crest occurs where they intersect at center 64 or at the other end where they are connected to rim 12. In any event, no point along crests 48, 50, 52, 54 should extend beyond the raised rim sections 16, 18, 20, 22 or be so low that a low point is created which will not drain into troughs 56, 58, 60, 62 via the inclined surfaces.

The troughs 56, 58, 60, 62 are generally triangular shaped surfaces which are alligned with and sloped toward the inner edge of depressions 24, 26, 28, 30 in rim 12 (see FIGS. 4 and 5). The troughs are also in flow communication with the depressions in the rim and together they form a continuous channel for the drainage of liquids deposited on the base when the bottle is in its inverted position. The sides of troughs 56, 58, 60, 62 are defined by the sides of a pair of the cooperatively sloped inclined surfaces 32, 34, 36, 38, 40, 42, 44, 46. In order to avoid the collection of liquids in the center of the base, center 64, which is formed by the intersection of crests 48, 50, 52, 54, must have a higher elevation (when the base is viewed in its inverted position) than any portion of troughs 56, 58, 60, 62 or depressions 24, 26, 28, 30.

Each inclined surface 32, 34, 36, 38, 40, 42, 44, 46 is also generally in the shape of a triangle. As illustrated with inclined surface 42, one leg of the triangle, AB, between corners A and B, forms part of crest 52 and, as illustrated, has approximately the same elevation along its entire length. Another leg, AC, forms one side of trough 60. Corner C of this triangle, located adjacent to the inner edge of depression 28 in rim 12, is positioned at a lower elevation than corners A and B and is preferably the lowest point on the inclined surface. This causes the plane of the inclined surface 42 to be directed relatively downward toward trough 60 and outward toward depression 28. This downward and outward inclination of the inclined surface assists in the drainage of liquids in the central section. Alternatively, as mentioned above, the elevation along leg AB may vary so that a high point exists somewhere along the leg. This is permissable so long as the inclination of the inclined surface remains generally downward and outward toward trough 60 and depression 28 in rim 12 and no liquid collection point is created along the crest or on the inclined surface. The inclined surfaces 32, 34, 36, 38, 40, 42, 44, 46 and central section 10 are connected to the rim sections 16, 18, 20, 22 via shoulders, such as 36*a* and 38*a,* which extend down from the rim sections.

When a bottle having the drainable base illustrated in the drawings and described above is inverted and liquid is poured or dropped on the base, all the liquid is directed by the crests and inclined surfaces toward the outwardly sloped troughs and out the depressions in the rim as is illustrated by the arrows in FIG. 3. When the crests are approximately the same elevation along their entire radial extent and the corner of the inclined surfaces nearest the openings are the lowest point on the surfaces, most of the liquid will tend to flow over the central and outer portions of the inclined surfaces and enter the troughs near the depressions.

Alternatively, if the outer ends of the crests, at the B corners of the inclined surfaces, are higher than the inner end, at center 64 and the A corners of the inclined surfaces, more of the liquid will tend to flow toward the center and through a greater length of the troughs.

In an alternative embodiment of the drainable base, the entire portion of the central section between the crests, i.e., a single trough and the pair of cooperatively sloped inclined surfaces adjacent the trough,may be formed into a single continuous draining surface which has no distant trough, but which is inclined and sloped away from its high points along the crests and at the center toward its lowest point which is located at the inner end of the rim depression associated with it.

The preferred embodiments illustrated and described herein are intended to be exemplary of the types of drainable container bases which fall within the scope of the invention. However, one skilled in the art would certainly be expected to be able to make modifications and variations of these preferred embodiments without departing from the spirit and scope of the invention as defined in the following claims.

What is claimed is:

1. A bottle having a drainable base, comprising:

a body having a round side wall;

a neck having an opening therein; and a base, integral with the lower edge of the side wall, the base having a central section, a rim section surrounding the central section, and a series of shoulders along the inner edge of the rim section to connect the rim section to the center section;

the central section having two or more radially extending raised ribs and an equal number of radially extending sloped throughs, each rib and trough being separated by a generally triangular shaped, planar, inclined surface which directs any liquid deposited on the base when the bottle is inverted toward a trough;

the rim section having generally flat raised portions extending higher than the ribs, and a number of depressions, each of which is formed by an outwardly and downwardly slanted center and by generally planar side walls disposed between the center and the rim's raised portions and is adjacent to and in flow communication with the outer end of one of the sloped troughs, to permit liquid collected in the troughs when the bottle is inverted to flow past the rim section and drain from the base;

the shoulders being disposed between the rim's raised portions and the center's planar inclined surfaces.

2. The base of claim 1, wherein the troughs and the depressions are located approximately equidistant between two adjacent raised ribs.

3. The base of claim 1, wherein there are four ribs, four raised rim portions, four depressions and eight inclined surfaces.

4. A bottle having a drainable base, comprising;

a body having a generally round side wall;

a neck having an opening therein; and a base, integral with the lower edge of the side wall, the base having a central section, a rim section surrounding the central section, and a series of shoulders along the inner edge of the rim section to connect the rim section to the central section;

the central section having two or more radially extending raised ribs and a generally smooth surface, composed of one or more generally planar surfaces, between each adjacent pair of ribs, sloped generally downward and outward toward a single low point along the outer edge of the central section;

the rim section having generally flat raised rim portions and a number of depressions, each depression being formed by an outwardly and downwardly sloped center and by generally planar side walls disposed between the center and the rim's raised portions, each depression corresponding to one of the low points of the central section and in flow communication with the low point to permit ready drainage of liquid from the central section when the bottle is inverted.

5. The base of claim 6, wherein their are four raised ribs, four generally smooth surfaces, four depressions and four raised rim portions.

6. A drainable base for a round bottle, comprising:

a central section having a series of triangularly shaped, generally planar slanted surfaces disposed about the center of the base, which form a series of alternating radially extending crests and outwardly and downwardly inclined troughs;

a rim surrounding the central section and connected to the lower edge of the side wall of the bottle, the rim having generally flat, raised pads for resting the bottle on a surface, and a depression in the rim adjacent to the outer end of each trough; and a series of shoulders along the inner edge of the pads between the pads and the central section's slanted surfaces.

7. The base of claim 6, wherein each depression is formed by an outwardly and downwardly slanted center and by generally planar side walls disposed between the center and the raised pads.

8. The base of claim 6, wherein there are eight slanted planar surfaces forming four crests and four troughs.

* * * * *

UNITED STATES PATENT AND TRADEMARK OFFICE

CERTIFICATE OF CORRECTION

PATENT NO. : 4,054,219

DATED : October 18, 1977

INVENTOR(S) : YOUNG and FRAZER

It is certified that error appears in the above-identified patent and that said Letters Patent are hereby corrected as shown below:

Column 1, line 59, add -- of -- after "series".

Column 2, delete lines 1-3.

Column 4, line 23, "distant" should read -- distinct --.

Claim 1, line 11, "throughs" should read -- troughs --.

Claim 5, line 1, "their" should read -- there --.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*